United States Patent [19]

Huether

[11] Patent Number: 4,707,332

[45] Date of Patent: Nov. 17, 1987

[54] SINTERING PROCESS FOR PREALLOYED POWDERS

[75] Inventor: Werner Huether, Karlsfeld, Fed. Rep. of Germany

[73] Assignee: MTU Moroten-und Turbinen-Union Muenchen GmbH, Munich, Fed. Rep. of Germany

[21] Appl. No.: 2,403

[22] PCT Filed: Feb. 7, 1986

[86] PCT No.: PCT/DE86/00044

§ 371 Date: Oct. 16, 1986

§ 102(e) Date: Oct. 16, 1986

[87] PCT Pub. No.: WO86/04840

PCT Pub. Date: Aug. 28, 1986

[30] Foreign Application Priority Data

Feb. 16, 1985 [DE] Fed. Rep. of Germany ..... 3505481

[51] Int. Cl.[4] ..... B22F 3/24

[52] U.S. Cl. ..... 419/28; 419/26; 419/29; 419/31; 419/33; 419/38; 419/42; 419/53; 419/54; 419/68; 420/590

[58] Field of Search ..... 419/33, 68, 38, 26, 419/28, 42, 31, 29, 53, 54; 420/590

[56] References Cited

U.S. PATENT DOCUMENTS

| | | | |
|---|---|---|---|
| 3,953,205 | 4/1976 | Cox et al. | 419/33 |
| 4,347,076 | 8/1982 | Ray et al. | 419/33 |
| 4,624,705 | 11/1986 | Jatkar et al. | 419/33 |

FOREIGN PATENT DOCUMENTS

| | | |
|---|---|---|
| 897921 | 11/1953 | Fed. Rep. of Germany . |
| 1257436 | 12/1967 | Fed. Rep. of Germany . |
| 2227700 | 6/1972 | Fed. Rep. of Germany . |
| 2258780 | 6/1973 | Fed. Rep. of Germany . |
| 1290458 | 3/1962 | France . |
| 2131457 | 6/1984 | United Kingdom . |

*Primary Examiner*—Stephen J. Lechert, Jr.
*Attorney, Agent, or Firm*—Barnes & Thornburg

[57] ABSTRACT

A process for manufacturing structural parts of complicated shape from intermetallic phases capable of sintering by means of special additives which serve at the same time as sintering assist and increase the ductility of the finished structural part. The process includes the steps of making by melting a pre-alloy of the intermetallic phase, comminuting the pre-alloy into fine powder and mixing the fine powder with one or more additives into a mass which can then be shaped and subsequently sintered at a temperature of 70 to 95% of the absolute melting point of the intermetallic phases into a structural part of increased ductility and a density greater than 95% of the theoretical density which might possibly be subjected to subsequent pressing operations.

11 Claims, No Drawings

SINTERING PROCESS FOR PREALLOYED POWDERS

TECHNICAL FIELD

The invention relates to a process for the manufacture of structural parts of complicated shapes from powder of intermetallic phases capable of being sintered. Intermetallic phases, especially TiAl, $TiAl_3$, NiAl, $NiAl_3$ have a low specific weight and high melting point. Materials on this basis are therefore interesting for the use in thermally and mechanically highly loaded structural parts, especially in aircraft propulsion units.

STATE OF THE ART

The problem of these materials reside in their brittleness. Processes are known for some time to increase the ductility of the intermetallic phases. This takes place by additionally alloying a further element, for example, B in NiAl or Nb in $TiAl_3$.

The materials are made heretofore by melting metallurgical techniques or by reaction of the elements, i.e., for example, Al powder is mixed with Ti powder and Nb powder and is heated in a ram press. Heat results during the chemical reaction which sets in and the desired alloy is formed. It has not been possible heretofore with this process to manufacture in a simple manner structural parts of complex shape.

DESCRIPTION OF INVENTION

It is the task of the invention to indicate a process which permits to manufacture in a simple manner structural parts from intermetallic phases which are of complicated shape. This is solved by the features of claim 1.

BEST MODE TO CARRY OUT THE INVENTION

One starts with a pre-alloy of the intermetallic phase which, apart from unavoidable impurities, only contains the same, for example, $Ni_3Al$, NiAl, TiAl, $TiAl_3$. This pre-alloy is obtained by melting.

By reason of the brittleness of the intermetallic phases, the pre-alloy can be ground in a manner known as such into a fine powder by any conventional means (impact mill, ball mill, air-jet mill) or can be atomized (as known as such, for example, from the DE-AS No. 22 22 830).

Granular size range:

0.5 $\mu$m to 50 $\mu$m, specific surface of 1 $m^2/g$ to 25 $m^2/g$. Preferred: 3 to 5 $m^2/g$ (BET-surface).

This powder is now mixed with a powder of one or several further elements. It is thereby desirable that the powders of the further elements are finer than that of the intermetallic phase.

As further elements are used those which effect an increase of the ductility of the intermetallic phase (for example, B for NiAl, Nb for $TiAl_3$ with a proportion of 0.5 to 10% by weight.

The prepared powder mixture can now be brought to its final shape, apart from a shrinkage of 10 to 20% (by volume), by any known methods:

(a) Providing with a binding agent, cold-isostatically pressing (CIP) in green condition. Binding Agents: Waxes, thermoplastics and/or duroplastics (CIP) see, for example, DE 33 28 954. Machining by grinding and polishing to the final dimensions.

(b) Preparing an injection-moldable mass with the aid of lubricants and binding agents, injection molding technologies as used with plastic materials. Expellable binding agents as in (a) Lubricant such as stearine. Injection molding by machines customary for plastics (for example, with heatable feed worm and mouthpiece, respectively, nozzles at the tip thereof), also by injection molding presses, extrusion presses and extruding.

The lubricant and binding agents are thereby removed by a heat treatment in a manner known as such (heat treatment in a vacuum or inert gas up to 600° C.). The sintering takes place in the same atmosphere as the aforementioned heat treatment and under conditions known as such, especially at temperatures above 900° C. but smaller than 95% of the melting temperature. This sintering can also take place in several stages.

The elements which were added for the increase of the ductility act at the same time as sintering assist so that at a temperature of 70 to 95% of the absolute melting point of the intermetallic phase, a sintering can be carried out successfully. Densities of 95 to 99% of the theoretical density are attained thereby within 0.1 to 24 hours.

Subsequently, the parts can be hot isostatically pressed in order to achieve practically 100% density. These HIP conditions are also known as such, utilizing pressures up to about 2500 bar (gas) and temperatures up to about 2000° C.

COMMERCIAL APPLICABILITY

Turbine blades or rotors, turbo-superchargers or other highly stressed parts (hot, rotating and/or chemically stressed), especially of flow machines.

I claim:

1. A process for the manufacture of structural parts of complicated shapes from powders of intermetallic phases capable of sintering, comprising the steps of making a pre-alloy of the intermetallic phases by melting, comminuting the pre-alloy into a fine powder, mixing into a mass the pre-alloy powder with at least one additive for increasing ductility, and sintering the thus-formed mass at a temperature of about 70 to about 95% of the absolute melting point of the intermetallic phase into a structural part of increased ductility and a density greater than 95% of the theoretical value.

2. A process according to claim 1, further comprising the step of imparting to the mixture of the powdered pre-alloy and additives a predetermined shape prior to sintering.

3. A process according to claim 2, including substantially pressing the sintered structural part.

4. A process according to claim 1, wherein the powder mixed with one or several additives is further processed prior to the sintering of the mass.

5. A process according to claim 4, wherein said additives are in elemental condition.

6. A process according to claim 4, wherein the mass including the mixture of powdered pre-alloy and additive is cold isostatically pressed prior to the sintering.

7. A process according to claim 4, wherein the mass including the mixture of powdered pre-alloy and additive is processed by injection molding prior to sintering.

8. A process according to claim 1, wherein the mass including the mixture of powdered pre-alloy and additives is further processed by injection molding prior to sintering.

9. A process according to claim 8, further comprising the step of heat treatment subsequent to the injection molding.

10. A process according to claim 9, further comprising the step of hot isostatically pressing the material subsequent to the sintering.

11. A process according to claim 4, further comprising the step of hot isostatically pressing the material subsequent to the sintering.

* * * * *